US010479383B2

(12) United States Patent
Fries et al.

(10) Patent No.: US 10,479,383 B2
(45) Date of Patent: Nov. 19, 2019

(54) SYSTEM AND METHOD FOR CONTROLLING A LEVEL CROSSING

(71) Applicant: ALSTOM TRANSPORT TECHNOLOGIES, Saint-Ouen (FR)

(72) Inventors: Jeffrey Fries, Grain Valley, MO (US); William Shields, Grain Valley, MO (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 241 days.

(21) Appl. No.: 15/466,103

(22) Filed: Mar. 22, 2017

(65) Prior Publication Data

US 2018/0273067 A1 Sep. 27, 2018

(51) Int. Cl.

| | |
|---|---|
| ***B61L 29/22*** | (2006.01) |
| ***B61L 23/00*** | (2006.01) |
| ***B61L 23/04*** | (2006.01) |
| ***B61L 29/30*** | (2006.01) |

(52) U.S. Cl.

CPC ..... *B61L 29/22* (2013.01); *B61L 23/005* (2013.01); *B61L 23/041* (2013.01); *B61L 29/30* (2013.01)

(58) Field of Classification Search

CPC ..... B61L 29/00; B61L 29/08; B61L 29/16; B61L 29/18; B61L 29/22; B61L 29/24; B61L 29/28; B61L 29/30; B61L 29/32

See application file for complete search history.

(56) References Cited

U.S. PATENT DOCUMENTS 7,715,276 B2 * 5/2010 Agam ..... B61L 23/041 367/96

* cited by examiner

*Primary Examiner* — Robert J McCarry, Jr.

(74) *Attorney, Agent, or Firm* — Troutman Sanders LLP

(57) ABSTRACT

A system for controlling a level crossing between a railway track and a road, the system comprising a first couple of transmitters and a second couple of transmitters in proximity of a level crossing area; a first couple of receivers and a second couple of receivers opposite to the transmitters with respect to the railway track, the first couple of transmitters and receivers located on a first side of the road and the second couple of transmitters and receivers located opposite to the first side, a control unit sending and receiving signals from said transmitters and receivers, wherein each couple of transmitters transmits a first beam from a first transmitter towards a corresponding first receiver, and a second beam from a second transmitter towards an opposite second receiver, the control unit activates sending at least one second beam and sends a warning message and/or close bars of the level crossing upon interruption of at least one first beam due to the presence of the train on the railway track.

8 Claims, 2 Drawing Sheets

SYSTEM AND METHOD FOR CONTROLLING A LEVEL CROSSING

FIELD OF THE INVENTION

The present invention relates to a system and a method for controlling a level crossing of a railway track.

BACKGROUND

A level crossing is an intersection where a railway line crosses a road or path at the same level, as opposed to railway line crossings using bridges or tunnels. The safety of level crossings is one of the most important issues of railways services. Each year about 400 people in the European Union and over 300 in the United States are killed in level crossing accidents. Collisions can occur with vehicles as well as pedestrians; pedestrian collisions are more likely to result in death.

As far as warning systems for road users are concerned, standard level crossings have either passive protections in the form of different types of warning signs, or active protections, using automatic warning devices such as flashing lights, warning tones and boom gates. Fewer collisions take place at level crossings with active warning systems.

Recently, railroad companies have started to control level crossings through wireless control systems of the trains (e.g. ITCS, ETCS, I-ETMS etc.), because this approach provides many benefits.

In these systems, a signal is wirelessly sent from a control unit of the train towards a control unit associated to the level crossing, thus allowing the latter to properly control the opening or closing of bars or gates placed in correspondence of the level crossing and arranged to prevent the crossing of the level crossing by vehicles or pedestrians present on the intersecting road or path.

This way of controlling the level crossings allows operations to be performed at speeds higher than the traditional activation through track circuits.

Level crossings operated through track circuits activate the crossing based either on initial occupancy of a section of track, or on detection of motion in any section of a track, or on prediction of arrival time based on changes in the electrical impedance of the track measured between the level crossing and the lead axle of the train.

All these track circuit methods have physical limitations as to how far from the crossing they can detect the train.

If a minimum amount of warning time is required for correctly closing the bars of a level crossing, then there is an upper limit to the maximum speed of the train at which track circuits can effectively and timely provide this warning time.

Wireless activation also enables constant warning prediction in areas where it was not previously possible (e.g. electrified rails, areas of poor shunting, etc.).

In some cases, railroad companies have considered to completely eliminate the activation of level crossing through track circuits and to operate them, namely, the bars present in correspondence of level crossings, through wireless activation only.

In fact, track circuits used to operate the bars represent a big expense for companies as they require constant adjustment and maintenance, and numerous train delays occur due to poor operation in harsh environmental conditions or when the track wires are damaged by the track maintenance equipment.

While the wireless level crossing activation potentially enables the elimination of the track circuits, the island track circuit is still required to keep the bars down when a train occupies a short area of a railway track placed on both side of a road.

In fact, a track circuit controlled level crossing generally has two different track circuits: one approach circuit and one island circuit.

The approach track circuit is a long distance circuit looking for the initial approach of the train, for the purpose of activating the warning devices. Any activation of the warning devices from the approach track circuit may be cleared if the train stops short of the crossing.

The island track circuit is a short distance circuit, that keeps the warning devices activated any time this circuit is occupied by any portion of the train.

The main drawback of these existing circuits is that they require both constant adjustment and maintenance, and a wired connection to the rails which is commonly damaged by track maintenance equipment.

As a result, the train movements are restricted until these wired connections are repaired and the level crossing equipment is tested and restored.

There is therefore the need to replace such island track circuits with a solution that is however capable of providing a SIL-4 (Safety Integrity Level) train detection, with a reliability equivalent to the one of the solution based on the island track circuits but that, on the other side, does not require wires attached to the rails or equipment in the fouling zone of track maintenance equipment. A fouling zone is an area where track maintenance equipments may damage devices of the railway track.

An object of the present invention is therefore to provide a system and a method for controlling a level crossing of a railway track which is capable of detecting the presence of a train on the railway track itself without the need of wires attached to the rails, thus enabling safe operation of bars placed in correspondence of the level crossing by overcoming the limitations of the prior art systems.

SUMMARY

This and other objects are achieved by a system for controlling a level crossing of a railway track having the characteristics defined in the below examples and by a corresponding method having the characteristics defined below.

Particular embodiments of the invention are the subject of the dependent claims, whose content is to be understood as an integral or integrating part of the present description.

BRIEF DESCRIPTION OF THE DRAWINGS

Further characteristics and advantages of the present invention will become apparent from the following description, provided merely by way of a non-limiting example, with reference to the enclosed drawings, in which.

DETAILED DESCRIPTION

Briefly, the system of the present invention comprises a plurality of transmitters and receivers of any type (e.g.

infrared, laser, radar, RF, etc.) arranged to exchange signals between each other so as to identify the presence of a train on a railway track.

Figure 1:
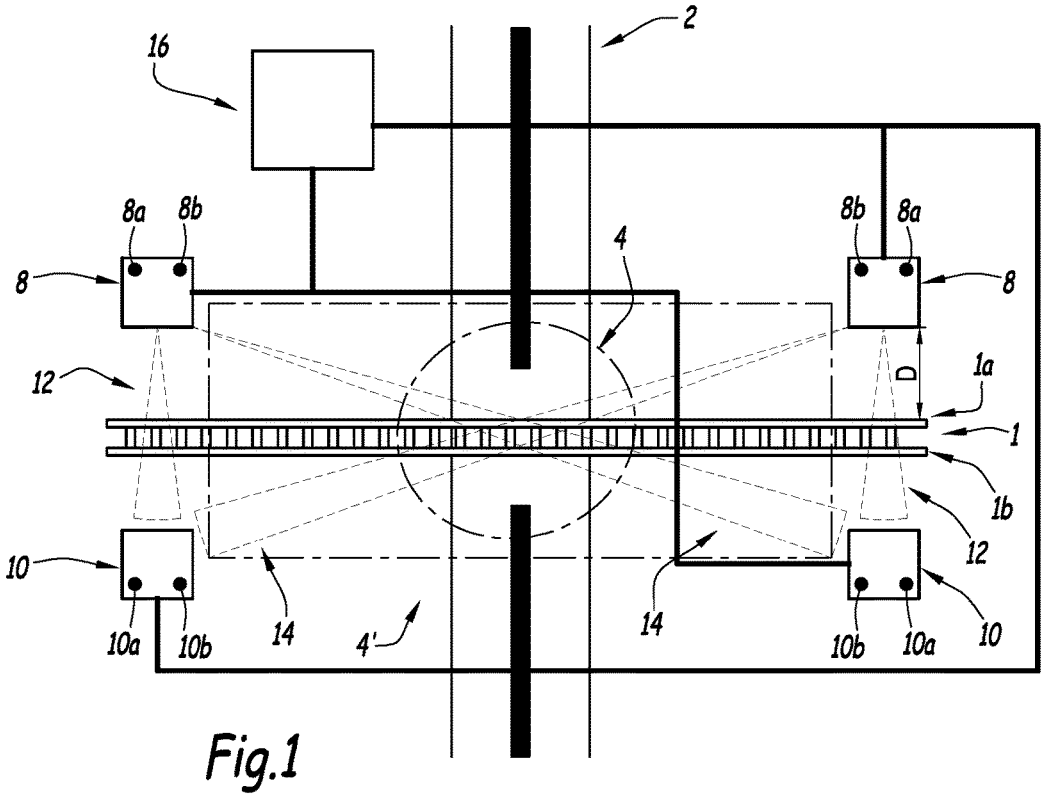
FIG. 1 shows a schematic top view of a level crossing provided with a system for controlling a level crossing according to the present invention.

FIG. 1 shows a schematic top view of a level crossing provided with a system for controlling a level crossing according to the present invention.

In FIG. 1, a railway track is indicated with reference 1; it comprises a first rail 1*a* and a second rail 1*b*.

A road 2 crosses perpendicularly the railway track 1, in a level crossing area 4.

A system for controlling a level crossing 6 comprises at least two transmitter boxes 8 located in proximity of the level crossing area 4 on a first side of the railway track 1, preferably at a distance D ranging from 10 to 50 feet from the first rail 1*a*, and at least two corresponding receiver boxes 10, located in proximity of the level crossing area 4 on a second side of the railway track 1 opposite to the first side where the transmitter boxes 8 are located.

Distance D is measured perpendicularly to railway track 1.

A transmitter box 8 and a receiver box 10 are corresponding boxes if they are located on the same side of the road 2. A transmitter box 8 and a receiver box 10 are opposite if they are located on opposite sides of the road 2.

Each transmitter box 8 comprises at least a first transmitter device 8*a* and a second transmitter device 8*b*. Each receiver box 10 comprises at least a first receiver device 10*a* and a second receiver device 10*b*.

The transmitter devices 8*a*, 8*b* and the receiver devices 10*a*, 10*b* can be pole mounted outside of the fouling zone of the railway track 1, i.e. attached to a pole if there are no mounting structures already present on the railway track 1.

The transmitter devices 8*a*, 8*b* are arranged to transmit towards the receiver devices 10*a*, 10*b* at least a total of four different beams. These four different beams include two first beams 12 going respectively from the first transmitter device 8*a* of each transmitter box 8 towards the corresponding first receiver device 10*a* of the corresponding receiver box 10 and passing above the rails 1*a*, 1*b* in a horizontal direction substantially perpendicular to railway track 1. These four different beams also include two second beams 14 going respectively from the second transmitter device 8*b* of each transmitter box 8 towards the opposite second receiver device 10*b* of the opposite receiver box 10 and passing above the road 2 in a horizontal direction inclined with respect to railway track 1.

The beams 12, 14 can be of infrared, laser, radar or RF type.

In each transmitter box 8, the first transmitter device 8*a* transmits the first beam 12 while the second transmitter device 8*b* transmits the second beam 14. In each receiver box 10, the first receiver device 10*a* receives the first beam 12 while the second receiver device 10*b* receives the second beam 14.

The transmitter and receiver boxes 8, 10 are operably connected through independent communications channels to a control unit 16 arranged to exchange signals with said transmitter and receiver boxes 8, 10 so as to detect the presence of a train in an area surrounding the level crossing area 4. The connection through independent communication channels can be wired or wireless.

In particular, the control unit 16 is arranged to send to the first transmitter devices 8*a* respective activation signals so that said first transmitter devices 8*a* can in turn start sending the respective first beams 12 towards the corresponding receiver devices 10*a*, in order to detect the entry of a train into an approaching area 4' surrounding the level crossing area 4.

The train, when moving on the railway track 1, can enter into the approaching area 4' from one side or from the opposite one with respect to the level crossing area 4, thus interrupting the first beams 12 respectively generated by a first transmitter device 8*a* or by the other first transmitter device 8*a*.

As soon as one of said first beams 12 is interrupted due to the presence of the train, the respective first receiver device 10*a* sends to the control unit 16*a* first alarm signal. The control unit 16 sends in turn to at least one of the second transmitter devices 8*b* an activation signal so that said second transmitter device 8*b* can start sending the respective second beam 14 towards the corresponding second receiver device 10*b*, in order to detect the entry of the train into the level crossing area 4.

In an alternative embodiment, the control unit 16 is arranged to activate the sending of both second beams 14 upon interruption of at least one first beam 12 due to the presence of the train on the railway track 1.

In addition, as soon as a first beam 12 is interrupted, the control unit 16 sends a warning message and/or sends towards bars present in correspondence of the level crossing a closing signal, thus allowing closing of the bars themselves When the second beam 14 is also interrupted due to the train which has moved forwards along the railway track 1 towards the level crossing area 4, the corresponding second receiver device 10*b* sends to the control unit 16*a* second alarm signal, so that the control unit 16 can be aware of the further approach of the train.

Level crossing warning devices such as the bars are therefore activated when any beam is interrupted, in particular any first beam 12 or any second beam 14, and they are deactivated only when all the first and second beams 12 and 14 are not interrupted.

Thanks to the above disclosed steps it is possible to avoid detections of vehicles moving on the road 2 prior to the train's arrival at the level crossing area 4.

Once the train occupies the level crossing area 4, the beams 12 and 14 are interrupted as the transmitters 8*a*, 8*b* of the boxes 8 have no longer visibility to the receivers 10*a*, 10*b*, thus resulting in an "island occupancy" situation detected by the control unit 16.

In a preferred embodiment, for increasing the security of the transmissions and for avoiding external noises, each transmitter device 8*a*, 8*b* modulates the respective beam 12, 14 with a safety CRC code on the beam itself, and each receiver device 10*a*, 10*b* validates the received beam only if it contains an expected checking data.

Figure 2:
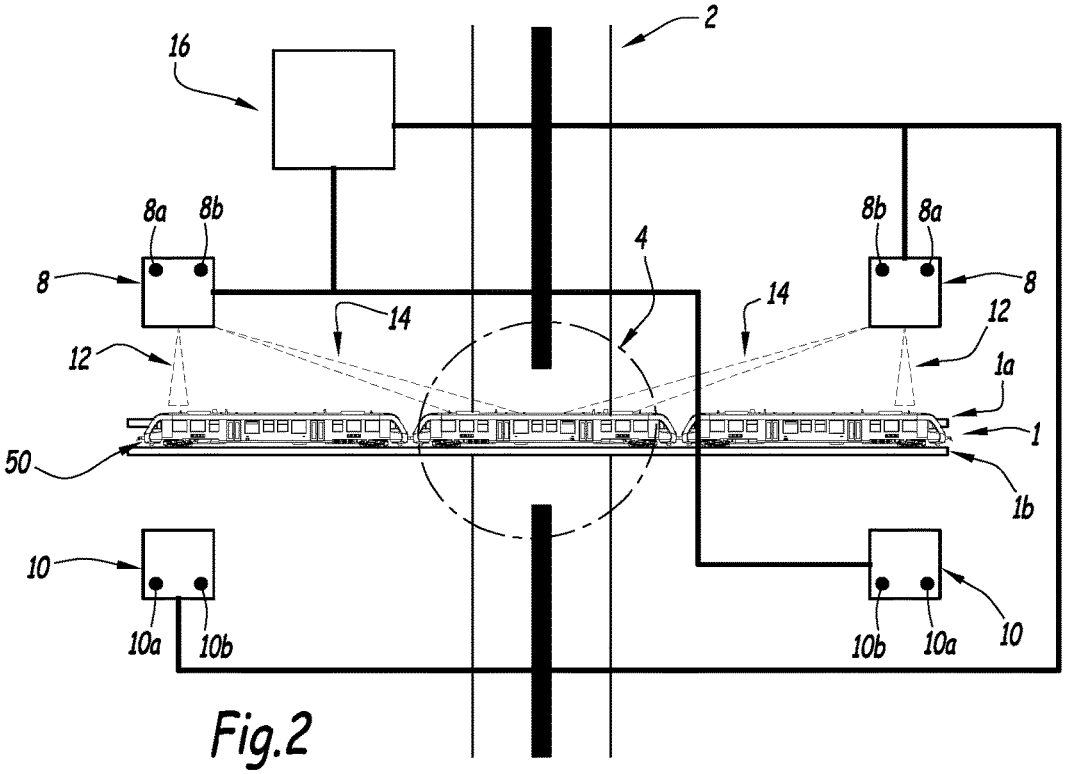
FIG. 2 shows the same schematic view of FIG. 1 with a train present on the railway track.

FIG. 2 shows the same schematic view of FIG. 1 with a train present on the railway track 1.

In FIG. 2*a* train 50 is shown on the railway track 1 in the level crossing area 4. In this situation, the transmitter devices 8*a*, 8*b* have no longer visibility of the receiver devices 10*a*, 10*b*, which in turn send the alarm signals to the control unit 16.

In the above disclosed system, any failure of the transmitter boxes 8 and receiver boxes 10, or any imprecision of their physical alignment, would also result in wrong and/or detections of beams, and the control unit 16 would consider these situations as occupancy of the level crossing area 4.

In order to, limit the possible influences of any failure of the transceivers 8 on the system of the present invention, in a preferred embodiment, the transmitter devices 8*a*, 8*b* are only activated when the control unit 16 is aware of an approaching train 50 that has, for example, requested wireless level crossing activation. For example, when a train 50 is approaching a level crossing, it automatically sends to the control unit 16 an activation signal, and at that point the control unit 16 starts monitoring of the receiver devices 10*a*, 10*b* so as to detect the presence of alarm signals.

In this way it is possible to avoid detection of occupancy of the level crossing due to objects other than the train (e.g. automobiles, humans, etc.) prior to the crossing activation.

The above disclosed operations of the system for controlling a level crossing 6 complies with the closed loop fail safety principle required for SIL-4 operation.

The control unit 16 performs known safety critical integrity tests on the devices so as to verify that the transmitter devices 8*a*, 8*b* and the receiver devices 10*a*, 10*b* are properly working. Examples of controls are those done on the transmitter gain, receiver gain, ADC integrity, etc.

Advantageously, a tri-axial accelerometer may be placed on each transmitter device 8*a*, 8*b* or receiver device 10*a*, 10*b* to detect, in a manner per se known, any misalignment between the devices once commissioned.

In the following part of the description, a method for controlling a level crossing according to the present invention will be disclosed in detail.

Figure 3:
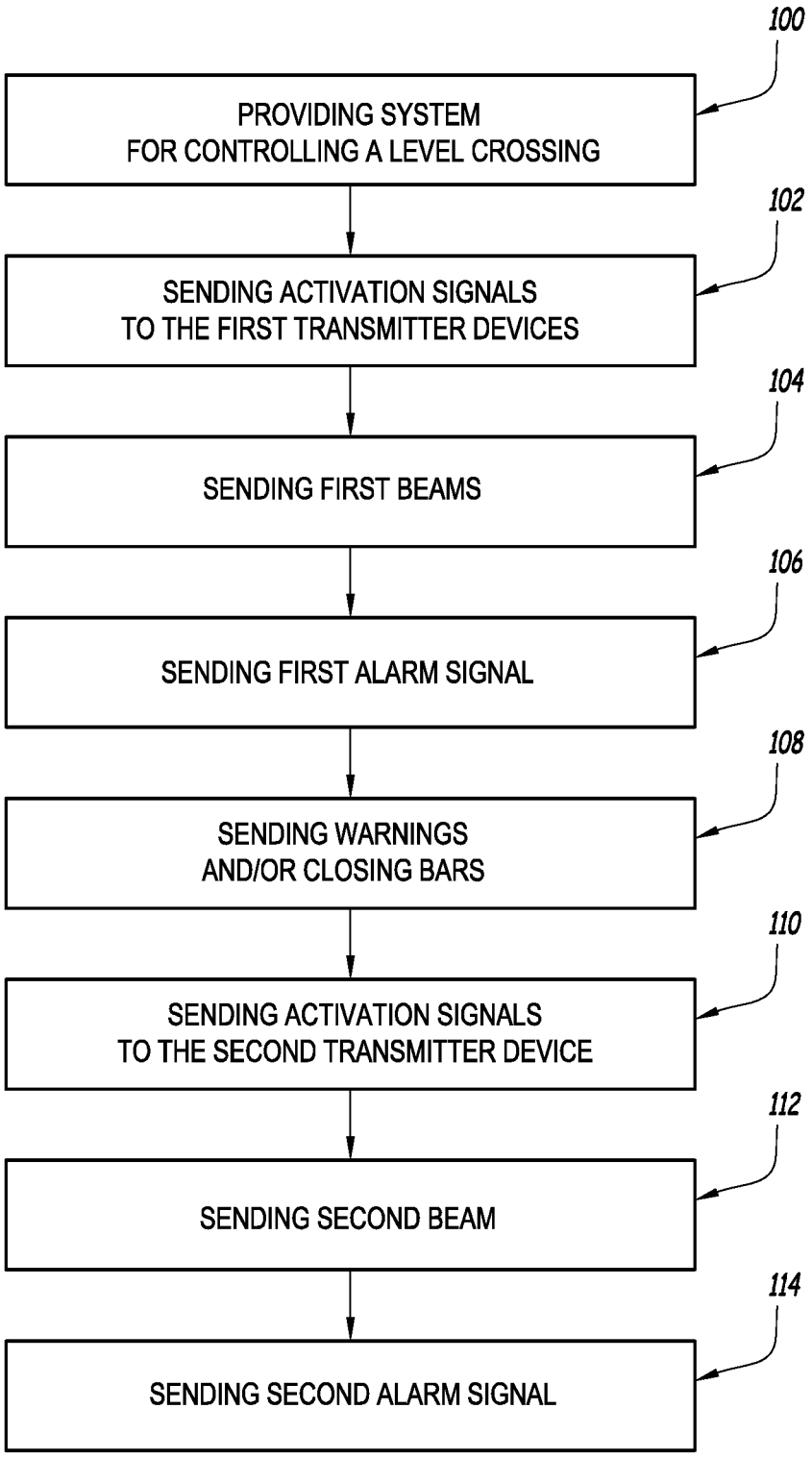
FIG. 3 shows a block diagram of the steps performed by the method for controlling a level crossing according to the present invention.

FIG. 3 shows a block diagram of the steps performed by the method for controlling a level crossing according to the present invention.

In a first step 100, a system for controlling a level crossing 6 of the type above disclosed is provided in correspondence of a level crossing between a railway track 1 and a road or path 2.

In a subsequent step 102 the control unit 16 sends to the first transmitter devices 8*a* respective activation signals, and at step 104 said first transmitter devices 8*a* start sending the respective first beams 12 towards the corresponding receiver devices 10*a*.

Once one of said first beams 12 is interrupted due to the presence of a train 50, at step 106 the respective transmitter device 10*a* sends to the control unit 16*a* first alarm signal.

Then, at step 108, the control unit 16 sends a warning message and/or sends towards bars present in correspondence of the level crossing a closing signal, thus allowing closing of the bars themselves.

Subsequently, in step 110, the control unit 16 sends an activation signal to at least one second transmitter device 8*b* so that said second transmitter device 8*b*, at step 112, starts sending the respective second beam 14 towards the corresponding second receiver device 10*b*.

When the second beam 14 is interrupted due to the presence of the train 50 moving forward on the railway track 1 towards the level crossing area 4, at step 114 the corresponding second receiver device 10*b* sends to the control unit 16*a* second alarm signal so as to inform the control unit 16 of a further approach of the train 50 into the level crossing area 4.

Clearly, the principle of the invention remaining the same, the embodiments and the details of production can be varied considerably from what has been described and illustrated purely by way of non-limiting example, without departing from the scope of protection of the present invention as defined by the attached claims.

The invention claimed is:

1. A system for controlling a level crossing between a railway track and a road, the system comprising:

at least one first couple of transmitter devices and at least one second couple of transmitter devices located in proximity of a level crossing area on a first side of the railway track;

at least one first couple of receiver devices and at least one second couple of receiver devices located in proximity of the level crossing area on a second side of the railway track opposite to the first side where the transmitter devices are located, the first couple of transmitter devices and receiver devices being located on a first side of the road and the second couple of transmitter devices and receiver devices being located on a second side of the road opposite to the first side where the first couples of transmitter devices and receiver devices are located, and a control unit arranged to send and receive signals from said couples of transmitter device and receiver devices so as to detect the presence of a train in correspondence of the level crossing area, wherein each couple of transmitter devices is arranged to transmit towards the couples of receiver devices a first beam going from a first transmitter device towards a corresponding first receiver device of the couple of receiver devices located on the same side of the road where the couple of transmitter devices is located, and a second beam going respectively from a second transmitter device towards an opposite second receiver device of the couple of receiver devices located on the side of the road opposite to the side where the couple of transmitter devices is located, and the control unit is arranged to activate the sending of at least one second beam and to send a warning message and/or close bars of the level crossing upon interruption of at least one first beam due to the presence of the train on the railway track, wherein for each couple of transmitter devices:

the control unit is arranged to send to the first transmitter device a first activation signal so that said first transmitter device start sending the first beam;

the associated first receiver device is arranged to send to the control unit a first alarm signal upon interruption of the corresponding first beam, so that the control unit sends to at least one second transmitter device a second activation signal and sends a warning message and/or closes bars of the level crossing;

the second transmitter device is arranged to send the second beam towards the associated second receiver device upon reception of said second activation signal;

the second receiver device is arranged to send to the control unit a second alarm signal upon interruption of the corresponding second beam, so that the control unit is informed of a further approach of the train into the level crossing area.

2. The system of claim 1, wherein the control unit is arranged to activate the sending of both second beams upon interruption of at least one first beam due to the presence of the train on the railway track.

3. The system according to claim 1, wherein the control unit is further arranged to receive from a second receiver device, upon interruption of the corresponding second beam, an alarm signal so as to be informed of a further approach of the train into the level crossing area.

4. The system according to claim 1, wherein each transmitter device modulates the respective beam with a safety code on the beam transmitted towards the receiver devices, and each receiver device validates the received beam only if the received beam contains a predetermined checking data.

5. The system according to claim 1, wherein the transmitter devices are only activated by the control unit when a train that is approaching a level crossing has sent to the control unit an activation signal.

6. The system according to claim 1, wherein a tri-axial accelerometer is placed on each transmitter device or receiver device to detect any unintentional misalignment once commissioned.

7. A method for controlling a level crossing comprising the steps of:

providing a system for controlling a level crossing according to claim 1 in correspondence of a level crossing between a railway track and a road;

for each couple of transmitter devices sending from the control unit to the first transmitter device a first activation signal;

sending from the first transmitter devices the first beams towards the associated receiver devices;

sending from one of said receiver devices to the control unit a first alarm signal upon interruption of the corresponding first beam due to the presence of a train;

sending a warning message and/or closing bars of the level crossings;

sending a second activation signal from the control unit to at least one second transmitter device;

sending from the second transmitter device the second beam towards the corresponding second receiver device; and sending from the second receiver device to the control unit a second alarm signal upon interruption of the corresponding second beam due to the train moving forward along the railway track.

8. The method according to claim 7, wherein the second activation signal is sent to all the second transmitter devices.

* * * * *